US008685609B2

(12) United States Patent
Sandler et al.

(10) Patent No.: US 8,685,609 B2
(45) Date of Patent: Apr. 1, 2014

(54) MARKING AGENT CONCENTRATION METHODS, MARKING AGENTS, AND HARD IMAGING METHODS

(75) Inventors: Mark Sandler, Rehovot (IL); Shai Lior, Rehovot (IL); Ilan Frydman, Tel Aviv (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 212 days.

(21) Appl. No.: 13/320,905

(22) PCT Filed: Jun. 30, 2009

(86) PCT No.: PCT/IB2009/006296

§ 371 (c)(1),
(2), (4) Date: Nov. 16, 2011

(87) PCT Pub. No.: WO2011/001199

PCT Pub. Date: Jan. 6, 2011

(65) Prior Publication Data

US 2012/0058426 A1 Mar. 8, 2012

(51) Int. Cl.
*G03G 9/08* (2006.01)

(52) U.S. Cl.
USPC ..... 430/112; 430/118.5; 430/137.22

(58) Field of Classification Search
USPC ..... 430/112, 118.5, 137.22
See application file for complete search history.

(56) References Cited

U.S. PATENT DOCUMENTS

| | | | |
|---|---|---|---|
| 4,794,651 | A | 12/1988 | Landa et al. |
| 5,206,108 | A | 4/1993 | Felder et al. |
| 5,254,427 | A | 10/1993 | Lane et al. |
| 5,306,590 | A | 4/1994 | Felder |
| 5,316,575 | A | 5/1994 | Lent et al. |
| 7,064,153 | B2 | 6/2006 | Bruck |
| 7,320,853 | B2 | 1/2008 | Chou et al. |
| 7,344,817 | B2 | 3/2008 | Chou et al. |
| 7,405,027 | B2 | 7/2008 | Chou et al. |
| 7,432,033 | B2 | 10/2008 | Chou et al. |
| 7,517,622 | B2 | 4/2009 | Golodetz et al. |
| 2008/0153025 | A1 | 6/2008 | Lai et al. |

FOREIGN PATENT DOCUMENTS

| | | |
|---|---|---|
| JP | 1989-150158 | 6/1989 |
| JP | 1995-104523 | 4/1995 |
| JP | 1995-301998 | 11/1995 |
| JP | 1996-123099 | 5/1996 |
| JP | 2000-066457 | 3/2000 |

OTHER PUBLICATIONS

Xeikon 5000plus Product Brochure, date unknown (2 pgs).
International Search Report and Written Opinion for PCT/IB2009/006296 dated Mar. 4, 2010 (12 pages).
Notification of Reason for Rejection for JP Appln. No. 2012-519,071 dated Nov. 19, 2013, 4 pgs (Eng. Translation).

*Primary Examiner* — Mark A Chapman

(57) ABSTRACT

A marking agent concentration method includes concentrating the marking agent by removing at least some liquid carrier between particles without substantially removing retained liquid carrier within the particles and without substantially modifying the particle structure, which is supported by the retained liquid carrier. The concentrated marking agent is supplied to distributors or end users of liquid marking agent. A concentrated marking agent includes solid clumps of agglomerated particles and a liquid carrier retained within the particles' individual structure. The clumps exhibit a median size greater than 90 μm. The concentrated marking agent exhibiting a solids content of from 40 wt % to less than 90 wt %. A hard imaging method includes combining a concentrated marking agent with additional liquid carrier, applying a shear force, dispersing particles from clumps, forming a liquid marking agent, and forming a hard image using the liquid marking agent.

14 Claims, 8 Drawing Sheets

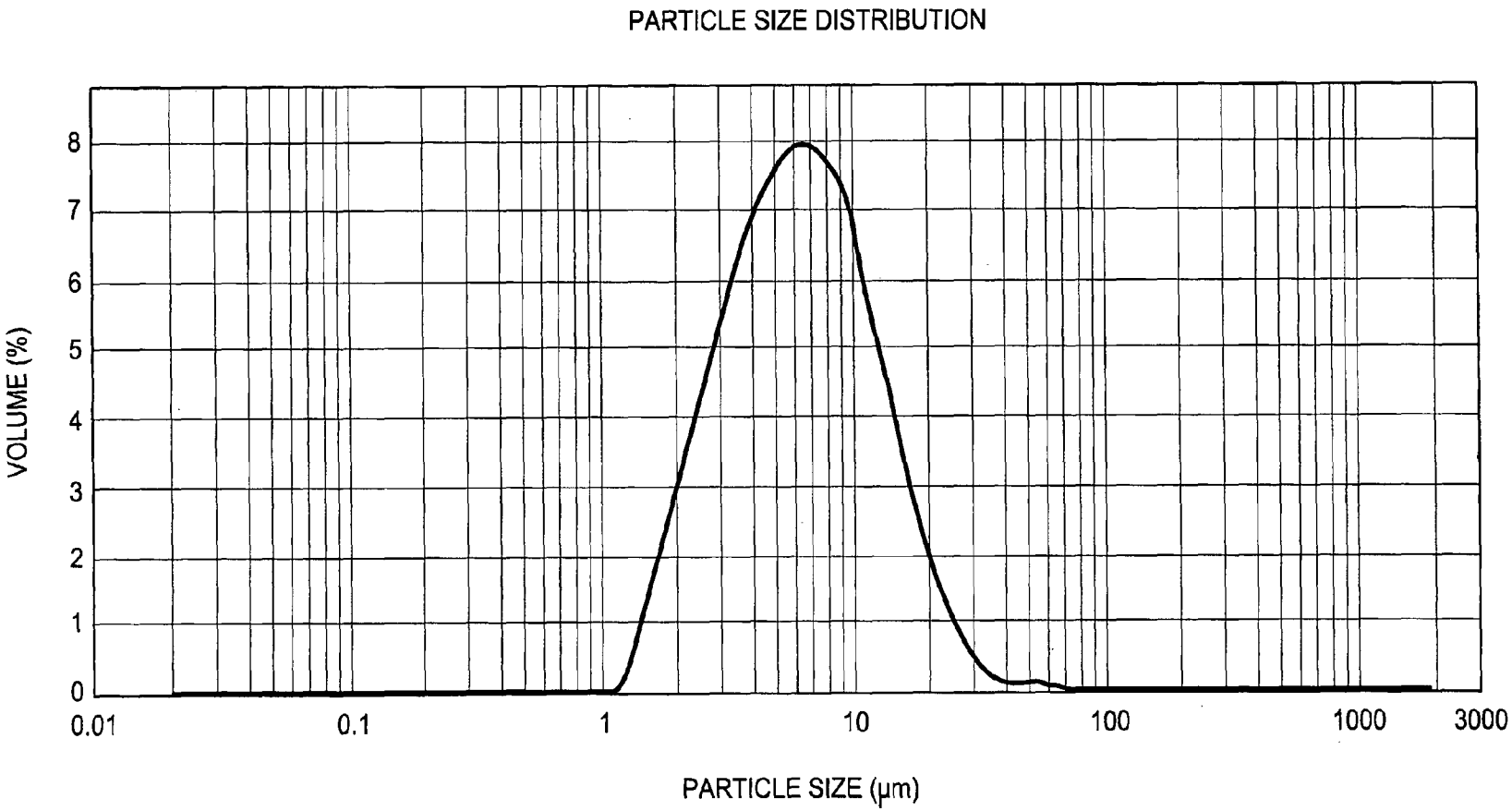
図 2A

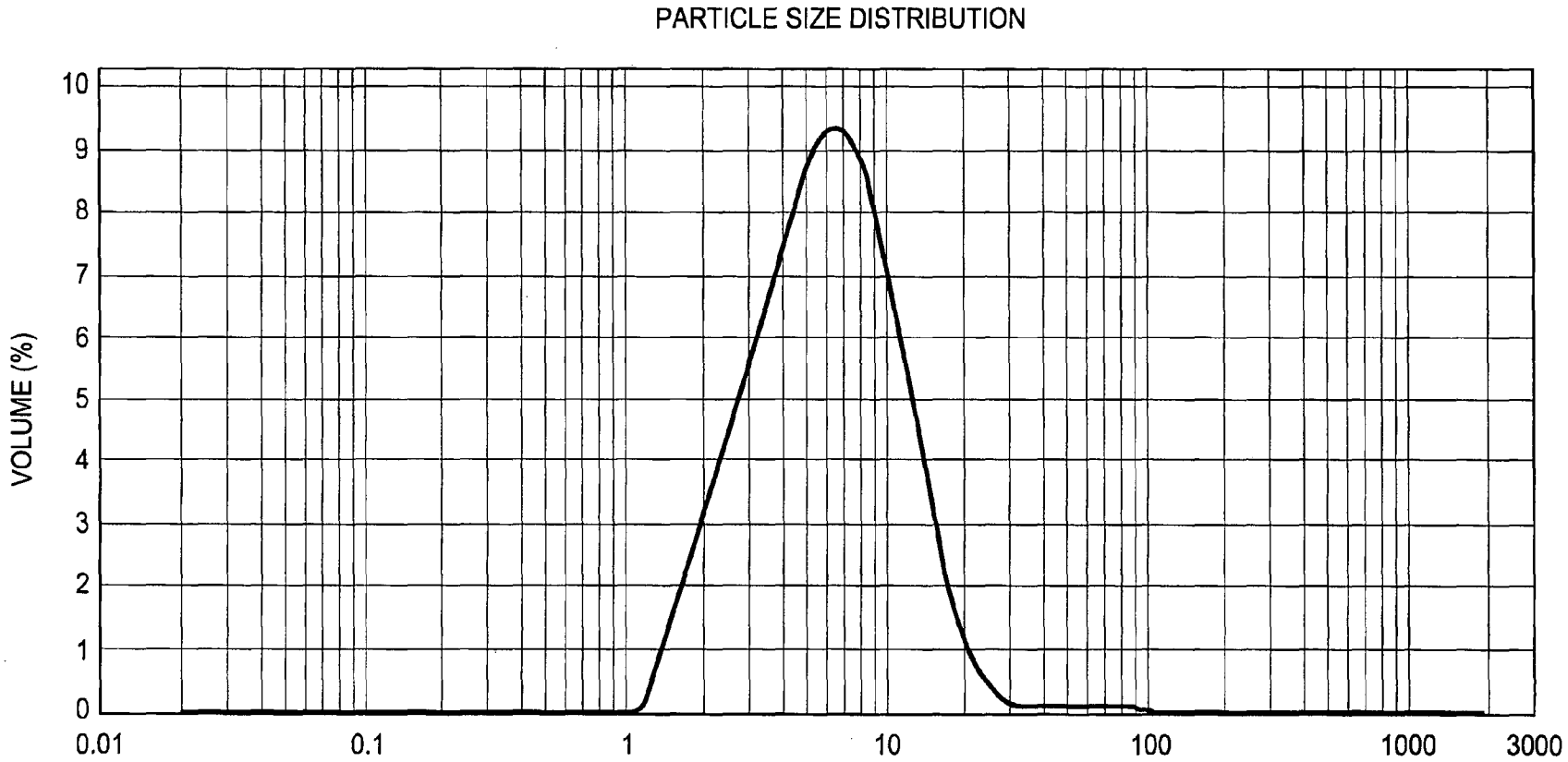
図 3

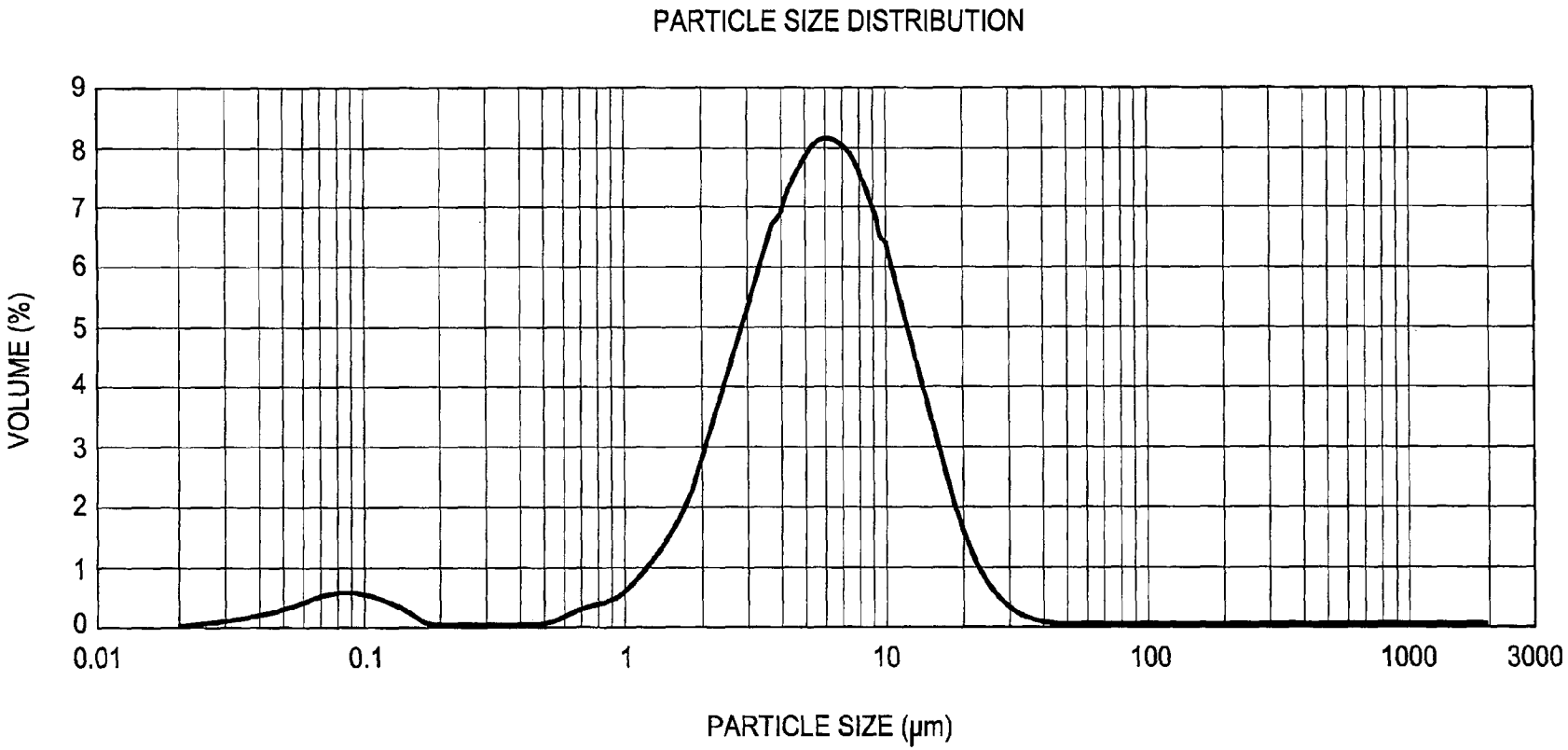
도면 3

MARKING AGENT CONCENTRATION METHODS, MARKING AGENTS, AND HARD IMAGING METHODS

BACKGROUND

Known liquid electrophotographic (LEP) presses generally use LEP ink containing imaging oil with volatile organic compounds (VOCs). HP ELECTROINK LEP ink produced, packaged, and shipped to printers typically contains 75 to 80 weight percent (wt %) imaging oil, depending mostly on the color. LEP ink may be further diluted, for example, to about 98 wt % imaging oil, prior to use in a press. The imaging oil may play a major role in achieving outstanding offset-like print quality with LEP presses. However, VOCs in the imaging oil are often regulated to avoid negative impact to the environment. Consequently, known LEP presses, such as the HP INDIGO 7000 Digital Press, include imaging oil recycling systems, which collect volatilized imaging oil and reuse it in the press. The imaging oil recovered from the press may exceed demand within the press for additional imaging oil, generating waste VOCs, which may be regulated substances. Known efforts to replace VOC components of imaging oil with non-VOC materials have not been successful.

BRIEF DESCRIPTION OF THE DRAWINGS

FIGS. 2A-2C, 3A, and 3B are charts representing particle size distributions of marking agents.

DETAILED DESCRIPTION OF THE EMBODIMENTS

Figure 1:
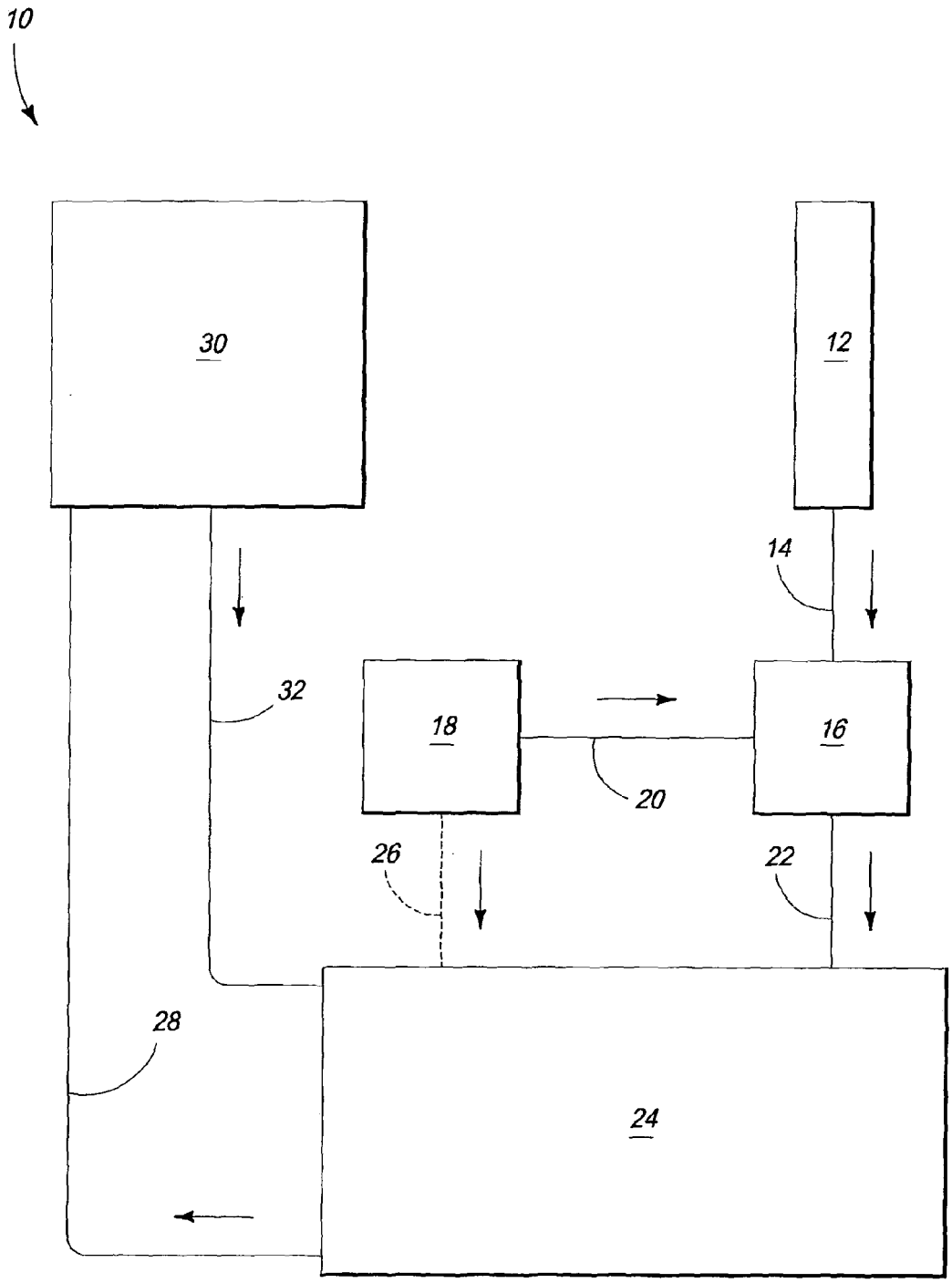
FIG. 1 is a diagram of a hard imaging device.
Figure 2C:
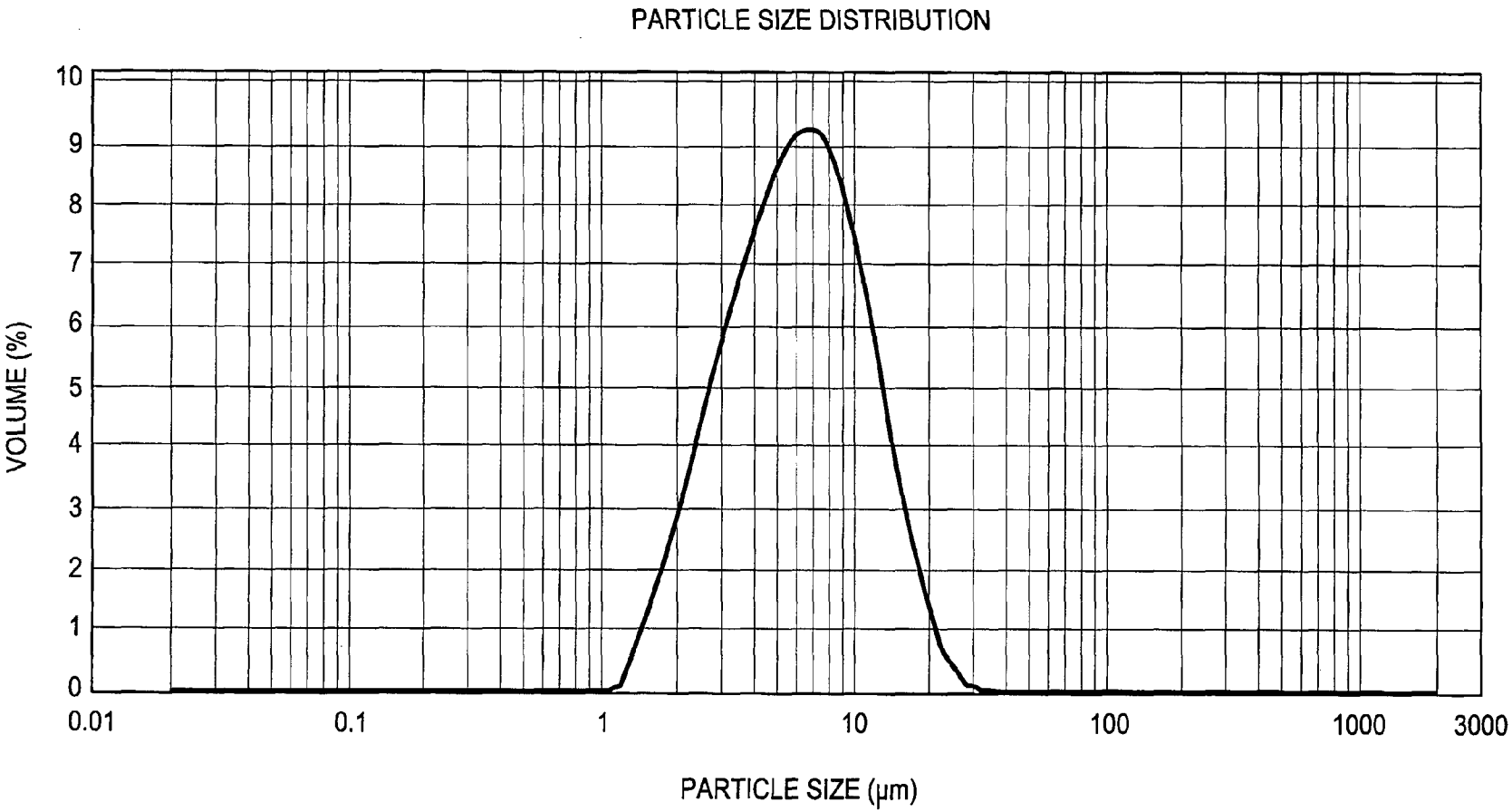
Figure 5A:
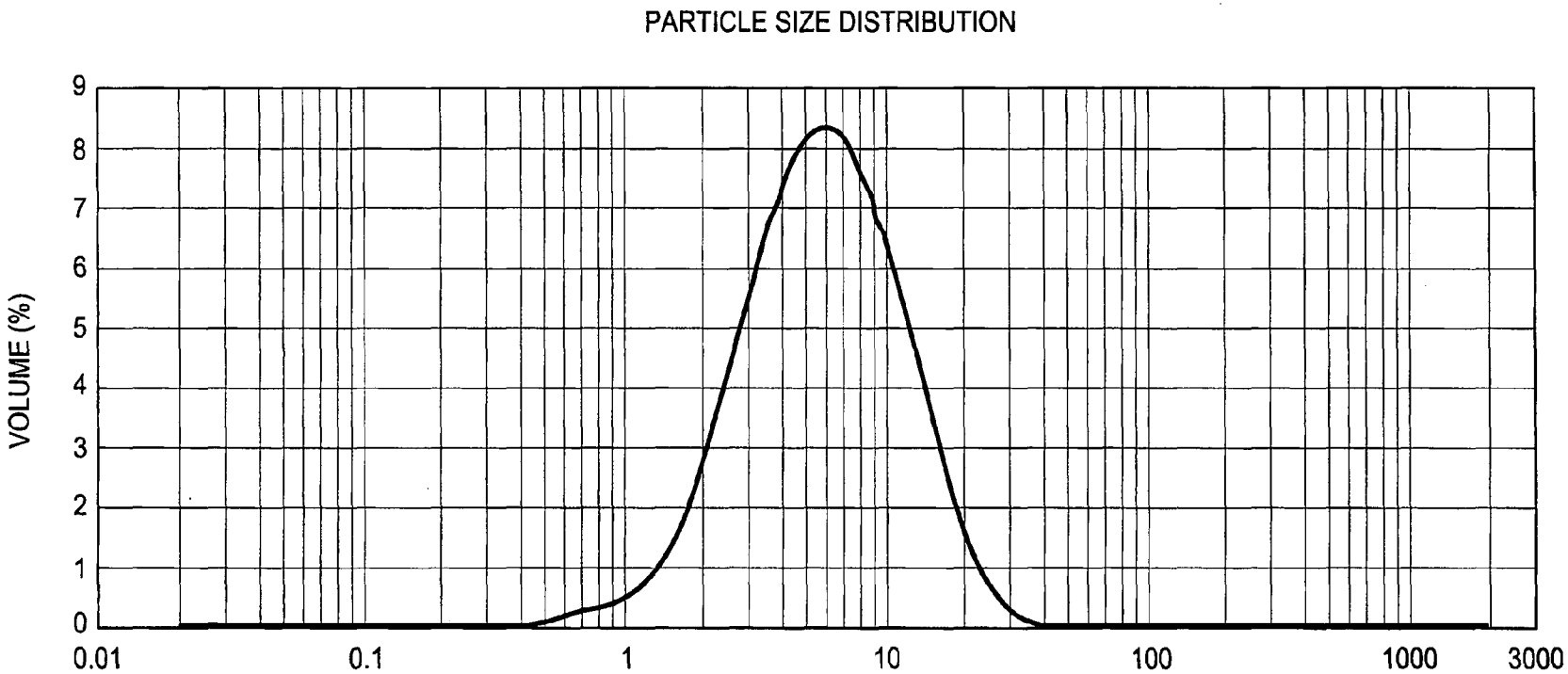
FIG. 5 is a diagram of selected components of an imaging engine for a hard imaging device.

The ink in final images produced on LEP presses may contain less than about 5 wt % imaging oil. Assuming a working solution stored in an ink tank of the press contains about 98 wt % imaging oil (about 2 wt % solids), more than 93 wt % of the working solution is excluded from the final image. The exclusion occurs over a few stages. The working solution from the ink tank supplies a development unit (for example, binary ink development (BID) unit) where some of the imaging oil squeezes out as it is applied, bringing the ink to 20-25% solids. The squeezed out imaging oil may return to the ink tank. The image transfer from a photo imaging plate (PIP) or imaging drum and its preparation on an intermediate transfer media (ITM) or blanket drum before transferring to paper or other media may exclude more imaging oil. Even allowing for some losses, much of the excluded ink is collected as recovered imaging oil. Since the ink supplied to press operators typically contains 75 to 80 wt % imaging oil (20-25 wt % solids), which is diluted to about 98 wt % imaging oil, it is readily apparent that the supply of recovered imaging oil may quickly exceed demand for imaging oil used in diluting the supplied ink.

Unfortunately, based on current practices, an expectation exists that concentrating LEP ink to a solids content of 30-35 wt % or higher irreversibly changes particle structures in the ink, degrading ink quality and essentially making it useless in a LEP press. As a result, concentrating currently supplied LEP ink so that press operators use more of the recovered imaging oil in diluting it to about 2 wt % solids would not appear viable. Even so, the embodiments described herein overcome current expectations and enable achieving a solids content of 40 wt % to less than 90 wt % while maintaining ink quality.

Although the discussion above is directed to LEP ink, the embodiments herein may be more broadly applicable. For that reason, references are made to a "marking agent," a generic term encompassing LEP ink and other substances. Similarly, although the discussion above is directed to imaging oil, the embodiments herein may be more broadly applicable. For that reason, references are made to a "liquid carrier," a generic term encompassing imaging oil and other substances. Further, although the discussion above is directed to LEP presses, the embodiments herein may be more broadly applicable. For that reason, references are made to "forming a hard image," a generic term encompassing printing with a LEP press and other methods. Thus, the embodiments may involve using a marking agent containing a liquid carrier to form a hard image, which encompasses using LEP ink containing imaging oil in a LEP press and other methods.

According to one embodiment, a marking agent concentration method includes providing a liquid marking agent containing particles dispersed in a liquid carrier, concentrating the marking agent, and supplying the concentrated marking agent to distributors or end-users of liquid marking agent. The concentrated marking agent exhibits a solids content of from 40 wt % to less than 90 wt %.

Presently, known marking agents are not supplied to distributors or end-users of liquid marking agent with a solids content of from 40 wt % to less than 90 wt %. An expectation exists that concentrating marking agent to a solids content of 30-35 wt % or higher irreversibly degrades ink quality by changing particle structures. As used herein, the term "distributor" refers to any entity that distributes liquid marking agent from a manufacturer to another distributor or an end-user. Distributors could include wholesalers, retailers, and other third-party intermediaries between the manufacturer and end-user.

The particles of the marking agent retain liquid carrier within their individual structure, which is supported by the retained liquid carrier. As one example, known LEP ink, or liquid toner, may include liquid carrier that is solvated by polymer resin contained in ink particles. As the resin solvates the liquid carrier, the ink particles swell to varying degrees, depending mostly on the particular polymer and liquid carrier. U.S. Pat. No. 7,517,622 issued to Golodetz et al. describes some examples.

The swelling from retained liquid carrier in LEP ink produces a particle structure highly desirable in LEP printing. The particle structure may also be advantageous in other hard imaging methods. Observation indicates concentration methods that remove the retained liquid carrier from within the particles cause irreversible damage to the particle structure. Hence, the expectation that concentrating marking agent to a solids content of 30-35 wt % or higher degrades ink quality.

In the embodiments herein, concentrating the marking agent may be performed by removing at least some liquid carrier between the particles without substantially removing the retained liquid carrier within the particles and without substantially modifying the particle structure. It might be possible to remove some de minimis or insubstantial amount of the retained liquid carrier within the particles without substantially modifying the particle structure, that is, by making only insubstantial modifications to the particle structure. The determination of whether the amount removed is substantial or insubstantial hinges on whether the removal substantially modifies the particle structure. Further, the determination of whether a modification to the particle structure is substantial or insubstantial hinges on whether the modification degrades marking agent quality to a measurable extent.

Known testing techniques exist for evaluating hard images. Such techniques may be used to evaluate hard images formed using previously concentrated marking agent and the extent of any degradation in marking agent quality. Marking agent quality may be determined mostly by handling behavior and imaging quality. That is, degraded marking agent quality may change the way re-dispersed marking agent is handled in a hard imaging device and/or change the appearance of hard images formed therewith. A measurable change in either handling behavior or imaging quality may indicate a substantial modification of the particle structure and thus may indicate removal of a substantial amount of retained liquid carrier within the particles. Observations in removing at least some liquid carrier between the particles without substantially removing the retained liquid within the particles and without substantially modifying the particle structure are discussed in the Examples below.

By way of example, the concentrated marking agent may exhibit the property of being re-dispersible to a particle size distribution sufficiently similar to a particle size distribution of the liquid marking agent for the re-dispersed and liquid marking agents to exhibit substantially the same imaging quality. A consistent particle size distribution constitutes one significant factor in determining whether marking agent quality was maintained. Consistent chargeability constitutes another significant factor. Accordingly, the concentrated marking agent may exhibit the property of being re-dispersible to provide a chargeability level sufficiently similar to a chargeability level of the liquid marking agent for the re-dispersed and liquid marking agents to exhibit substantially the same imaging quality.

The marking agent in the embodiments herein may include electrophotographic ink. Concentrating the marking agent may include using at least centrifugal and/or electrostatic force. Other techniques may be used instead of or in addition to centrifugal and/or electrostatic force. Concentrating the marking agent may further include using evaporation of at least some additional liquid carrier between the particles without substantially removing the retained liquid carrier within the particles and without substantially modifying the particle structure.

Using centrifugal force, electrostatic force, and/or evaporation will be appreciated as methods that may impose very little, if any, mechanical force on individual particles. Any known centrifugal separators, electrostatic separators, and/or evaporation devices may be used that yield a product consistent with the descriptions herein. Since the particles in LEP ink are chargeable, they are amenable to electrostatic separation. Currently, centrifugal and electrostatic separation appear to yield similar results, with centrifugal separation seemingly providing a slight higher solids content. In comparison, using filter presses, calendaring rollers, extensive drying, etc. may impose mechanical force on individual particles and/or substantially remove retained liquid carrier, modifying the particle structure.

A relatively high amount of energy, mostly in the form of heat, would normally be used to remove all liquid carrier from a marking agent. For known LEP ink, such as HP ELECTROINK, applying a high amount of energy may produce a phase change in the chemical system created during ink preparation. In the embodiments, a phase change in the chemical system may degrade marking agent quality and is thus avoided by using less energy than an amount sufficient to accomplish the phase change. A phase change in the chemical system begins to occur when the amount of liquid carrier in swelled particles of the marking agent falls below an amount sufficient to support individual particle structure. Consequently, evaporation of liquid carrier in air, by forced-air ventilation, and/or by heating air to less than about 45° C., for example, 40-45° C., for a limited time may be used to avoid accomplishing a phase change.

Observation of concentrated marking agents indicated they may be classified as a solid material at a solids content of about 35 wt %. In the range of solids content from about 35 wt % to 55 wt %, the concentrated marking agents had the appearance of very viscous paste or partially dried clay. When manually crumbled, the concentrated marking agents evidenced visually identifiable granules. At a solids content above about 55 or 60 wt %, the concentrated marking agents took on the appearance of being dry. Even so, concentrated marking agents with a solids content from 40 wt % to less than 90 wt % were demonstrated as re-dispersible without evidence of irreversible changes in particle structure.

At 90 wt % solids content and higher, evidence of structural damage appeared as indicated by the inability to re-disperse to a similar particle size distribution using the processes described herein. Essentially, with at least some liquid carrier removed between the particles, the particles agglomerate into solid clumps, but may retain liquid carrier within the particles when processed as described herein. If the retained liquid carrier is sufficient, upon re-dispersion, the agglomerations separate and the particle size distributions of the original marking agent again become apparent.

In the embodiments, the concentrated marking agent may include solid clumps of agglomerated particles, the clumps exhibiting a median size and the particles exhibiting a median size less than the median clump size. The clumps may exhibit a median size greater than 90 micrometers (μm) and the particles may exhibit a median size less than 10 μm. For example, the clump median size may be from 90 to 200 μm. Also, for example, the particles may exhibit a median size on the order of 1 μm. The solids content may be from 55 wt % to 70 wt %, thus providing a solid product while reducing liquid carrier content and avoiding, by a significant margin, higher levels of concentration that may cause damage to particle structure. The concentrated marking agent may be sealed in a container for handling, distribution, and storage to avoid further loss of liquid carrier to the extent that damage to particle structure occurs.

The marking agent concentration method may further include sizing the solid clumps of agglomerated particles to produce free-flowing, solid clumps of agglomerated particles as the concentrated marking agent. Known techniques and devices for solid material processing and sizing appropriate for the properties of the solid clumps may be used essentially to crumble the solid clumps into granules of a desired size distribution. Such processing and sizing techniques and devices may be known generally. Nevertheless, processing such a solid marking agent to be ultimately used as a liquid marking agent represents a significant departure from known practices.

In known methods, great care is often taken in producing dry toner particles destined for formation of liquid toner to be certain that the dry toner particle size matches the desired size of particles in the liquid toner. However, in the embodiments herein, agglomerations of particles may intentionally remain to reduce damage to particle structure. Hence, the concentrated marking agent supplied to distributors or end-users of liquid marking agent may contain clumps exhibiting a median size greater than the median particle size.

In one embodiment, a concentrated marking agent includes solid clumps of agglomerated particles and a liquid carrier retained within the particles' individual structure, which is supported by the retained liquid carrier. The clumps exhibit a median size greater than 90 μm and the concentrated marking agent exhibits a solids content of from 40 wt % to less than 90 wt %. It will be appreciated that such a concentrated marking agent may be produced by the methods described herein. By way of example, the particles comprised by the clumps may exhibit the property of having a median size less than 10 μm after dispersion in a liquid carrier. Other features described herein for other embodiments may also apply to the present embodiment.

In one embodiment, a hard imaging method includes providing a concentrated marking agent containing solid clumps of agglomerated particles and a liquid carrier retained within the particles' individual structure, which is supported by the retained liquid carrier. The clumps exhibit a median size. The method includes combining the clumps with additional liquid carrier, applying a sheer force within the combination of clumps and additional carrier, dispersing the particles from the clumps in the additional carrier, and forming a liquid marking agent. The dispersed particles exhibit a median size less than the median clump size. The method also includes forming a hard image on a substrate using the liquid marking agent. By way of example, the concentrated marking agent may exhibit a solids content of from 40 wt % to less than 90 wt %, such as from 55 wt % to 70 wt %.

As mentioned, liquid carrier, including the liquid carrier retained in particles of the marking agent, may contain a volatile organic compound (VOC), VOCs may be regulated substances subject to restriction in products and waste disposal. Consequently, advantages may exist in decreasing VOC content of marking agents.

FIG. 1 shows a hard imaging device 10 in which a hard imaging method may be practiced. Other hard imaging devices may be suitable. Hard imaging device 10 includes a marking agent dispenser 12 in which a concentrated marking agent may be supplied. A supply path 14 extending from marking agent dispenser 12 provides the concentrated marking agent to a dispersion unit 16. Hard imaging device 10 also includes a carrier dispenser 18 in which a liquid carrier may be supplied. A supply path 20 extending from carrier dispenser 18 provides the liquid carrier to dispersion unit 16. A shear force may be applied by dispersion unit 16 within the combination of concentrated marking agent and liquid carrier.

Sufficient concentrated marking agent and liquid carrier may be provided in dispersion unit 16 to yield a solids content of from 4 to 25 wt %, for example, from 10 to 20 wt %. That is, dispersion unit 16 may produce a liquid marking agent having a solids content of 20-25 wt %, as is often used for LEP ink. Alternatively, the liquid marking agent may have a lower solids content closer to the often used about 2 wt % solids content in the working solution.

A supply path 22 provides the liquid marking agent to a reservoir 24. Additional liquid carrier may be added to reservoir 24 to yield a desired working solids content. The additional liquid carrier may be added from carrier dispenser 18 through optional supply path 26 shown in dashed line. Alternatively, additional liquid carrier may be added from a different source (not shown). A supply path 28 provides liquid marking agent at its working solids content from reservoir 24 to an imaging engine 30. A return path 32 returns excess liquid carrier from imaging engine 30 to reservoir 24, reflecting initial squeezing of liquid marking agent from about 2 wt % solids to about 20-25 wt % solids before application. Reservoir 24 may be configured to maintain density, conductivity, and temperature of liquid marking agents within desired limits. As a result, re-dispersion of concentrated marking agent may be performed and liquid marking agent delivered on a just-in-time basis at a hard imaging device, such as a LEP press.

Figure 4:
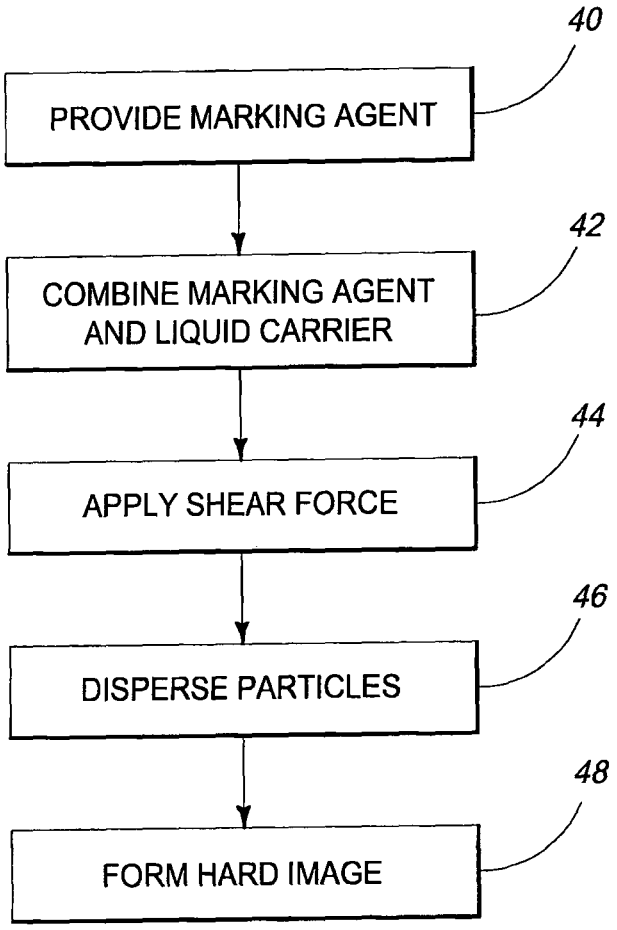
FIG. 4 is a flow diagram of a hard imaging method.

According to the flow diagram shown in FIG. 4, a hard imaging method performed, for example, in hard imaging device 10, may include providing solid marking agent at step 40. At step 42, the marking agent may be combined with a liquid carrier. Application of a shear force may occur in step 44 followed by dispersion of particles in step 46. A liquid marking agent containing the dispersed particles may be used in step 48 to form a hard image.

Figure 5:
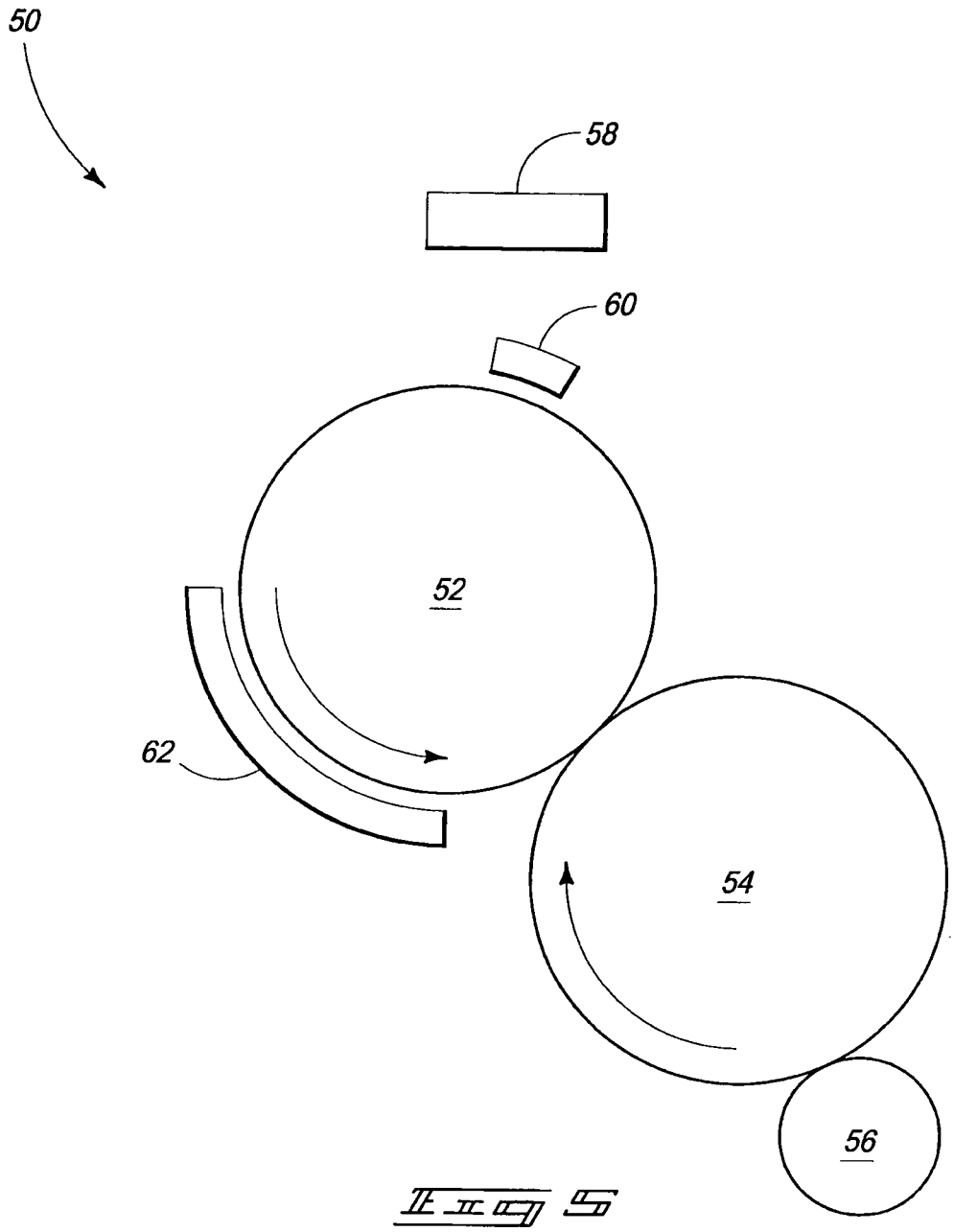

A print engine 50 shown in FIG. 5 represents one example suitable for use as imaging engine 30. The depicted arrangement of print engine 50 is configured to implement electrophotographic imaging wherein latent images are developed to form developed images subsequently transferred to output media to form hard images. Print engine 50 may be included in digital presses (for example, INDIGO presses available from the Hewlett-Packard Company), which use a liquid marking agent. Although, other configurations may be used.

Print engine 50 includes a plate cylinder 52, a charging unit 60, a writing unit 58, development units 62, and a blanket cylinder 54. Print engine 50 is configured to form hard images on media, such as paper or other suitable imaging substrates. Other hard imaging devices may include more, less, or alternative components or other arrangements in other embodiments.

Charging unit 60 may be configured to deposit a blanket electrical charge on substantially an entirety of an outer surface of plate cylinder 52. Writing unit 58 may be configured to discharge selected portions of the outer surface of plate cylinder 52 to form latent images. Development units 62 may be configured to provide a marking agent on the outer surface of plate cylinder 52 to develop the latent images formed thereon. The marking agent may be a liquid marking agent. Particles of the liquid marking agent may be electrically charged to the same electrical polarity as the blanket charge provided to the outer surface of plate cylinder 52 and are thus distributed to the discharged portions of the outer surface of plate cylinder 52 corresponding to the latent images. Developed images may be transferred by blanket cylinder 54 to media passing between blanket cylinder 54 and an impression cylinder 56.

Understandably, a hard imaging device using print engine 50 may include additional electrical, mechanical, and software components (not shown for simplicity) to accomplish formation of a hard image. It will be appreciated that in the event print engine 50 is used as image engine 30 in hard imaging device 10 shown in FIG. 1, supply path 28 provides liquid marking agent to development units 62. Development units 62 may include 1 to 7, or even more, colors for development of latent images on plate cylinder 52. Consequently, hard imaging device 10 may include a reservoir, such as reservoir 24, corresponding to each color. A corresponding marking agent dispenser, such as marking agent dispenser 12, and a dispersion unit, such as dispersion unit 16, may be provided for each reservoir.

In one embodiment, a hard imaging device includes a marking agent dispenser configured to operate with a marking agent containing solid clumps of agglomerated particles, a liquid carrier dispenser, and a dispersion unit. The dispersion unit is configured to combine dispensed marking agent and dispensed liquid carrier. The dispersion unit includes a mechanism configured to apply a shear force to combined marking agent and liquid carrier. The hard imaging device includes a reservoir configured to store liquid marking agent from the dispersion unit and an image engine configured to receive liquid marking agent from the reservoir. By way of example, the reservoir and/or hard imaging device may also be configured to combine the liquid marking agent with further liquid carrier in the reservoir before forming a hard image.

Since the embodiments herein allow a supply of concentrated marking agent to be provided to end users without degrading marking agent quality, several benefits may result. Assuming liquid carrier collected from concentration methods is recycled, marking agent manufacturers may purchase less liquid carrier. For a liquid carrier content of 75-80 wt % decreased to 35 wt % (65 wt % solids), carrier purchases may decrease by a factor of greater than 2. Assuming liquid carrier recycling systems of hard imaging devices provide the liquid carrier used to re-disperse the concentrated marking agent, end users may generate less VOC waste.

Less liquid carrier in the product may further mean a decreased mass in shipments for an equivalent supply of marking agent on the basis of how many pages may be imaged from the supply. Viewed another way, less liquid carrier in the product may mean a decreased number of shipments for a given volume of packaging containers. That is, the utilization life of a container with a given volume of marking agent may increase, if filled with concentrated marking agent having 40-90 wt % solids instead of 20-25 wt % solids. Achieving a solids content of 65 wt % may prove to be significant in complying with VOC regulations and avoiding special VOC capture and control devices on LEP presses. These and other benefits may be further appreciated from the Examples below illustrating various embodiments.

EXAMPLE 1

Cyan ELECTROINK El4.0 liquid electrophotographic (LEP) ink available from HP INDIGO Digital Press Division in Rehovot, Israel and having a solids content of 22.0±0.5 weight percent (wt %) was placed in the basket of a BK-24 centrifugal separator with a 3 liter capacity available from M.R.C. Ltd. in Holon, Israel. After centrifuging at 3000 revolutions per minute (RPM) for 30 minutes (min) and removing some of the liquid carrier (namely, Isopar L available from ExxonMobil Chemical in Houston, Tex.), the resulting clumps of agglomerated particles had a solids content of 47 wt %. The centrifuge product had the appearance of partially dried clay which, when manually crumbled, evidenced visually identifiable granules.

EXAMPLE 2

The product of Example 1 was removed from the centrifugal separator and placed in open air to further decrease carrier content by evaporation. After 25-50 hours (hr) of evaporation, depending on relative humidity (RH), the product had the visual appearance of being dry. Solids content of the product subject to evaporation was 60 wt %. Alternatively, the carrier content could be decreased more rapidly with forced-air ventilation and/or air heated to about 40-45° C. The clumps of agglomerated particles were manually crumbled into granules of varying size, but were of a character disposed to optimized crumbling into granules greater than about 90 μm, mostly within the range of about 90 to about 200 μm, for handling and shipment convenience.

EXAMPLE 3

Examples 1 and 2 were repeated using cyan ELECTROINK El3.1 LEP ink available from HP INDIGO Digital Press Division in Rehovot, Israel and having a solids content of 21.0±0.5 wt % with similar results. Solids content of the product subject to evaporation was 60 wt %. The clumps of agglomerated particles were manually crumbled into granules of varying size, but were of a character disposed to optimized crumbling into granules greater than about 90 μm, mostly within the range of about 90 to about 200 μm, for handling and shipment convenience.

EXAMPLE 4

The 60 wt % solids product of Example 2 made from cyan ELECTROINK El4.0 was placed in a funnel along with sufficient Isopar L liquid carrier to yield a solids content of 15 wt %. The funnel drained into a DGD09 direct drive gear pump available from Fluid-O-Tech in Milano, Italy operating at 3200 RPM that extracted the combined clumps and additional carrier and recirculating them back to the funnel. The combination was pumped through the apparatus for about 10 minutes, re-dispersing the ink particles. Alternatively, a blender, high shear mixer, or ball crusher could be used with similar effect. The alternative devices were found less dependent on a granule size and were able to re-disperse ink granules of a few millimeters in size. A high shear mixer is a specially designed device, sometimes including a few stages of shear application, and is distinguished from a blender, which usually applies lower shear and looks much simpler, more like the known home appliance. Also, alternatively, solids content could be from 4 to 25 wt %, for example, from 10 to 20 wt %.

EXAMPLE 5

Example 4 was repeated with the 47 wt % solids product of Example 1 made from cyan ELECTROINK El4.0 to yield a solids content of 15 wt %. Also, alternatively, solids content could be from 4 to 25 wt %, for example, from 10 to 20 wt %.

EXAMPLE 6

Example 4 was repeated with the 60 wt % solids product of Example 3 made from cyan ELECTROINK El3.1 to yield a solids content of 20 wt %. Some other trials involved re-dispersion to as low as 4 wt % solids content, which is close to the often used about 2 wt % solids content in the working solution. In comparison to Examples 4-6, the extra dilution during re-dispersion was observed to decrease efficiency of the process by increasing the circulation time to complete re-dispersion.

EXAMPLE 7

Particle size analysis was conducted on the starting inks of Example 1 (cyan ELECTROINK El4.0) and Example 3 (cyan ELECTROINK El3.1) and on the three re-dispersed inks of Examples 4-6 using a Mastersizer 2000 particle size analyzer available from Malvern Instruments Ltd. in Worcestershire, United Kingdom to produce the particle size distributions shown in FIGS. 2A-C and 3A-B. Noticeably, the size distributions of the starting inks were closely maintained and median particle size remained within a tolerance of about 0.3 μm, or about 5%. It is expected that median particle size staying within a tolerance of about 8-10% may be acceptable. The vol % of particles greater than 20.00 μm also constitutes a useful indicator of maintaining the size distribution. It is expected that inks with less than about 6 vol % of particles greater than 20.00 μm may be acceptable, for example, in HP INDIGO LEP presses. Size distribution parameters are compared in Table 1 for the individual Examples above, but should not be considered as statistically representative or as indicating a product specification.

TABLE 1

| | Fig. | D (0.5) | D (0.9) | vol % >20.00 μm | vol % <1.50 μm |
|---|---|---|---|---|---|
| cyan EI4.0 | 2A | 6.052 | 14.942 | 4.22 | 1.43 |
| Ex. 4 (60 wt %) | 2B | 5.989 | 12.928 | 2.03 | 1.02 |
| Ex. 5 (47 wt %) | 2C | 6.035 | 12.963 | 1.37 | 0.77 |
| cyan EI3.1 | 3A | 5.988 | 14.232 | 3.13 | 3.25 |
| Ex. 6 (65 wt %) | 3B | 5.652 | 13.561 | 2.58 | 7.01 |

D (0.5) = median; 50 volume percent (vol %) of particles below this size (μm)
D (0.9) = 90 vol % of particles below this size (μm)

EXAMPLE 8

The starting ink of Example 1 (cyan ELECTROINK EI4.0) and the re-dispersed ink of Example 4 were used to prepare working solutions of 2.0 to 2.1% solids content. Low field conductivities of the working solutions were measured in the range of 10-13 picoMhos (pMho) for both working solutions.

EXAMPLE 9

The inks of Examples 1, 3, and 4-6 were supplied to a HP INDIGO 5000 Digital Press and printed on Condat Gloss paper, 135 gram/meter$^2$. Comparison of the starting inks of Examples 1 and 3 and the three re-dispersed inks of Examples 4-6 did not reveal any identifiable differences in material handling behavior and print quality. As one example, no deviation in ink charging was observed. Print quality was evaluated by comparing the completeness of thin lines, text, and special features. Low field conductivities of working solutions of 80-90 pMho (per ink specification) were maintained by equally well in all inks tested with controlled addition of charging agent to the ink reservoir.

The invention claimed is:

1. A method for preparing a concentrated marking agent, consisting of:

providing a liquid marking agent containing particles dispersed in a liquid carrier, wherein the particles also retain liquid carrier within their individual structure, which is supported by the retained liquid carrier; and concentrating the marking agent by removing at least some liquid carrier between the particles without substantially removing the retained liquid carrier within the particles and without substantially modifying the particle structure, wherein the marking agent is an electrophotographic ink, and wherein the concentrated marking agent exhibits a solids content of from 40 wt % to less than 90 wt %.

2. The method of claim 1 wherein concentrating the marking agent comprises using at least centrifugal force electrostatic force, evaporation, or combinations thereof.

3. The method of claim 1 wherein concentrating the marking agent comprises evaporating the at least some liquid carrier between the particles by: evaporation in air; forced-air ventilation; heating the air to less than about 45° C.; or combinations thereof.

4. The method of claim 1 wherein the concentrated marking agent exhibits the property of being re dispersible to a particle size distribution sufficiently similar to a particle size distribution of the liquid marking agent for the re dispersed and liquid marking agents to exhibit substantially the same imaging quality.

5. The method of claim 1 wherein the concentrated marking agent exhibits the property of being re dispersible to provide a chargeability level sufficiently similar to a chargeability level of the liquid marking agent for the re dispersed and liquid marking agents to exhibit substantially the same imaging quality.

6. The method of claim 1 wherein the concentrated marking agent comprises solid clumps of agglomerated particles, the clumps exhibiting a median size and the particles exhibiting a median size less than the median clump size.

7. The method of claim 6 further comprising sizing the clumps to produce free-flowing, solid clumps of agglomerated particles as the concentrated marking agent.

8. The method of claim 1 wherein the solids content is from 55 wt % to 70 wt %.

9. A concentrated marking agent, comprising:

solid clumps of agglomerated electrophotographic ink particles; and a liquid carrier retained within the particles' individual structure, which is supported by the retained liquid carrier;

wherein the solid clumps exhibit a median size greater than 90 μm;

and wherein the concentrated marking agent exhibits a solids content of from 40 wt % to less than 90 wt %.

10. The agent of claim 9 wherein the particles comprised by the clumps exhibit the property of having a median size less than 10 μm after dispersion in liquid carrier.

11. A hard imaging method, comprising:

providing a concentrated marking agent containing solid clumps of agglomerated particles and a liquid carrier retained within the particles' individual structure, which is supported by the retained liquid carrier, the clumps exhibiting a median size greater than 90 μm, wherein the marking agent is an electrophotographic ink;

combining the clumps with additional liquid carrier;

applying a shear force within the combination of clumps and additional carrier;

dispersing the particles from the clumps in the additional carrier and forming a liquid marking agent, the dispersed particles exhibiting a median size less than the median clump size; and forming a hard image on a substrate using the liquid marking agent.

12. The method of claim 11 wherein the particles exhibit a median size less than 10 μm.

13. The method of claim 11 wherein the concentrated marking agent exhibits a solids content of from 40 wt % to less than 90 wt %.

14. The method of claim 11 comprising, after dispersing the particles, combining the liquid marking agent with further liquid carrier before forming the hard image.

* * * * *

UNITED STATES PATENT AND TRADEMARK OFFICE

CERTIFICATE OF CORRECTION

PATENT NO. : 8,685,609 B2
APPLICATION NO. : 13/320905
DATED : April 1, 2014
INVENTOR(S) : Mark Sandler et al.

It is certified that error appears in the above-identified patent and that said Letters Patent is hereby corrected as shown below:

In the Claims

In column 9, line 56, in Claim 2, delete “force” and insert -- force, --, therefor.

Signed and Sealed this
Twenty-second Day of July, 2014

Michelle K. Lee

Michelle K. Lee
*Deputy Director of the United States Patent and Trademark Office*